US006861632B2

(12) United States Patent
Lee

(10) Patent No.: US 6,861,632 B2
(45) Date of Patent: Mar. 1, 2005

(54) MICROWAVE OVEN

(75) Inventor: Se Hun Lee, Incheon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/629,787

(22) Filed: Jul. 30, 2003

(65) Prior Publication Data

US 2004/0134906 A1 Jul. 15, 2004

(30) Foreign Application Priority Data

Jan. 9, 2003 (KR) ..... 10-2003-0001432

(51) Int. Cl.[7] ..... H05B 6/64

(52) U.S. Cl. ..... 219/757; 219/746; 219/748; 219/749; 219/750; 219/691; 219/695; 219/745

(58) Field of Search ..... 219/757, 746, 219/748, 749, 750, 691, 693, 695–697, 745

(56) References Cited

U.S. PATENT DOCUMENTS

| | | | |
|---|---|---|---|
| 3,526,737 | A | 9/1970 | Black |
| 3,867,605 | A | 2/1975 | Yee |
| 4,105,886 | A | 8/1978 | Baron et al. |
| 4,144,436 | A | 3/1979 | Hauck |
| 4,289,945 | A | 9/1981 | Kristof |
| 4,568,811 | A | 2/1986 | Yoshimura et al. |
| 5,151,569 | A | 9/1992 | Suh |
| 5,371,343 | A | 12/1994 | Yoshimura et al. |

FOREIGN PATENT DOCUMENTS

| | | |
|---|---|---|
| JP | 06-295786 | 10/1994 |

OTHER PUBLICATIONS

Communication including a European Search Report mailed by the European Patent Office dated Feb. 20, 2004.

*Primary Examiner*—Shawntina Fuqua
(74) *Attorney, Agent, or Firm*—Staas & Halsey LLP

(57) ABSTRACT

A microwave oven includes a motor for a stirrer and a motor mounting unit. The motor is provided at an outer circumferential surface thereof with a first flange having a hole. The motor mounting unit is provided on an outer surface of a wave guide, and includes a seat, a mounting piece provided at an edge of the seat and having a hole, and a stopper. The stopper is upwardly projected from a first piece provided on the seat adjacent to the mounting piece, to delimit a mounted position of the motor. The motor mounting unit also includes a guide piece upwardly projected from a second piece provided at an edge of the seat. A slot is longitudinally formed along the guide piece. The motor has a second flange at a position opposite to the first flange to be fitted into and guided along the slot.

20 Claims, 6 Drawing Sheets

MICROWAVE OVEN

CROSS-REFERENCE TO RELATED APPLICATIONS

This application claims the benefit of Korean Patent Application No. 2003-1432, filed Jan. 09, 2003, in the Korean Intellectual Property Office, the disclosure of which is incorporated herein by reference.

BACKGROUND OF THE INVENTION

1. Field of the Invention

The present invention relates to microwave ovens, and more particularly, to a microwave oven having a structure that allows a motor for a stirrer, which serves as a microwave dispersing device to uniformly disperse microwaves into a cooking cavity, to be easily and rapidly mounted to the microwave oven.

2. Description of the Related Art

Generally, microwave ovens are appliances which heat and/or cook food laid in their cooking cavities using high-frequency electromagnetic waves generated by magnetrons installed in machine rooms. That is, during a cooking operation, the magnetron installed in the machine room irradiates the high-frequency electromagnetic waves, so-called "microwaves", into the cooking cavity. The microwaves penetrate food so as to repeatedly change the molecular arrangement of water laden in the food, thus causing the molecules of the water to vibrate and generate frictional heat within the food to cook the food. Such microwave ovens are typically classified into two types, that is, a general type microwave oven and a wall-mounted type microwave oven. The general type microwave oven is placed on a countertop of a cooking space. The wall-mounted type microwave oven is mounted to a wall of a cooking space, and collaterally serves to exhaust gas or smoke produced from an oven range positioned below the wall-mounted type microwave oven, in addition to carrying out a cooking function.

FIG. 1 shows a conventional wall-mounted type microwave oven. As illustrated in FIG. 1, the conventional wall-mounted type microwave oven includes a cabinet 10 which defines an external appearance of the microwave oven. The cabinet 10 is partitioned into a cooking cavity 11 and a machine room 12.

An exhaust passage 13 is defined around lower portions and rear portions of the cooking cavity 11 and the machine room 12 to guide exhaust gas or smoke produced from an oven range (not shown) placed below the cabinet 10, so as to discharge the exhaust gas or smoke to the outside of the microwave oven. A fan motor 14 and two exhaust fans 15 are provided at an upper-rear portion of the cabinet 1 to suck the exhaust gas or smoke guided along the exhaust passage 13 and discharge the exhaust gas or smoke to the outside. In this case, the exhaust fans 15 are mounted to both ends of the fan motor 14. The exhaust passage 13 forms a path which is partitioned from the cooking cavity 11 and the machine room 12.

A cooling fan 16 is installed in the machine room 12 to cool several electrical devices that operate the microwave oven. A front air intake grill 17 is provided at an upper portion of a front of the machine room 12 to suck external air into the machine room 12 where the cooling fan 16 is operated. Further, a plurality of perforations 19 are formed on a partition wall 18 by which the cooking cavity 11 and the machine room 12 are partitioned from each other, so as to have the air sucked into the machine room 12 flow into the cooking cavity 11 through the perforations 19, thus ventilating the cooking cavity 11. A plurality of perforations (not shown) are formed on an upper portion of a wall of the cooking cavity 11 which is opposite to the partition wall 18, thus exhausting the air from the cooking cavity 11. A front air discharging grill 20 is provided at an upper portion of a front of the cabinet 10 so as to discharge the air exhausted from the cooking cavity 11 to the outside of the microwave oven through the front air discharging grill 20 of the cabinet 10.

The electrical devices of the machine room 12 include a magnetron 21 which irradiates microwaves into the cooking cavity 11 to cook food. A wave guide 24 is mounted to a ceiling 22 of the cooking cavity 11 and the machine room 12 so as to guide the microwaves from the magnetron 21 into the cooking cavity 11. A stirrer 30 is mounted at an outlet of the wave guide 24.

The stirrer 30 includes a fan 31 and a motor 32. The fan 31 has a plurality of blades, and the motor 32 rotates the fan 31. Thus, where the fan 31 is rotated by the motor 32, the microwaves are dispersed in several directions in the cooking cavity 11. The fan 31 is provided at a position inside the wave guide 24. The motor 32 is mounted to an outer surface of the wave guide 24, and is axially connected to the fan 31.

FIG. 2 shows a plan view of a conventional motor mounting unit for mounting the motor 32 to the wave guide 24. As illustrated in the drawing, to mount the motor 32 to the wave guide 24, a bracket 35 is provided on the outer surface of the wave guide 24.

Two flanges 33 are projected from an outer circumferential surface of the motor 32 so as to be diametrically opposite to each other. A plurality of holes 34 are formed on each flange 33 to mount the motor 32 to the bracket 35. Further, a plurality of holes (not shown) corresponding to the holes 34 are formed on both sides of the bracket 35.

To mount the motor 32 to the bracket 35, the holes 34 formed on the flanges 33 of the motor 32 are aligned with the holes of the bracket 35, and screws 36 are tightened into the aligned holes.

However, with the conventional motor mounting structure described above, the holes 34 provided on the flanges 33 of the motor 32 may be misaligned with the holes provided on the bracket 35, even with a slight movement of the motor 32 while the screws 36 are tightened into the aligned holes. Accordingly, it is difficult and time consuming to mount the motor 32 to the wave guide 24.

SUMMARY OF THE INVENTION

Accordingly, it is an aspect of the present invention to provide a microwave oven having a motor mounting structure which allows a motor for a stirrer to be rapidly and precisely mounted to a wave guide.

Additional aspects and/or advantages of the invention will be set forth in part in the description which follows and, in part, will be obvious from the description, or may be learned by practice of the invention.

To achieve the above and/or other aspects of the present invention there is provided a microwave oven comprising a cabinet having a machine room and a cooking cavity, a magnetron which is installed in the machine room and generates microwaves, a wave guide which guides the microwaves from the magnetron into the cooking cavity, a stirrer which is mounted at a predetermined position of the wave guide and comprises a fan which disperses the microwaves and a motor which rotates the fan and includes a flange which is provided at a predetermined portion of an outer circumferential surface thereof, the flange having at least one hole, and a motor mounting unit which is provided on an outer surface of the wave guide and comprises a mounting piece which is provided with at least one hole corresponding to the hole of the flange and a stopper which delimits a mounted position of the motor.

The motor mounting unit may further comprise a seat which receives the motor. The mounting piece may be provided at an edge of the seat, and the stopper may be upwardly projected from a first piece which is provided at an edge of the seat adjacent to the mounting piece.

The motor mounting unit may further comprise a guide piece which is upwardly projected from a second piece that is provided at an edge of the seat opposite to the mounting piece, the guide piece having a longitudinal slot, and the motor may further include a guide flange provided at a position opposite to the flange so so as to be fitted into and guided along the longitudinal slot.

The motor may further include a terminal unit which is outwardly projected from the outer circumferential surface of the motor at a position between the flange and the guide flange. The terminal unit may be stopped by the stopper of the motor mounting unit in response to the hole of the flange being aligned with the hole of the mounting piece, thus delimiting the mounted position of the motor.

BRIEF DESCRIPTION OF THE DRAWINGS

These and/or other aspects and advantages of the invention will become apparent and more readily appreciated from the following description of the preferred embodiment, taken in conjunction with the accompanying drawings of which.

DETAILED DESCRIPTION OF THE PREFERRED EMBODIMENTS

Figure 1:
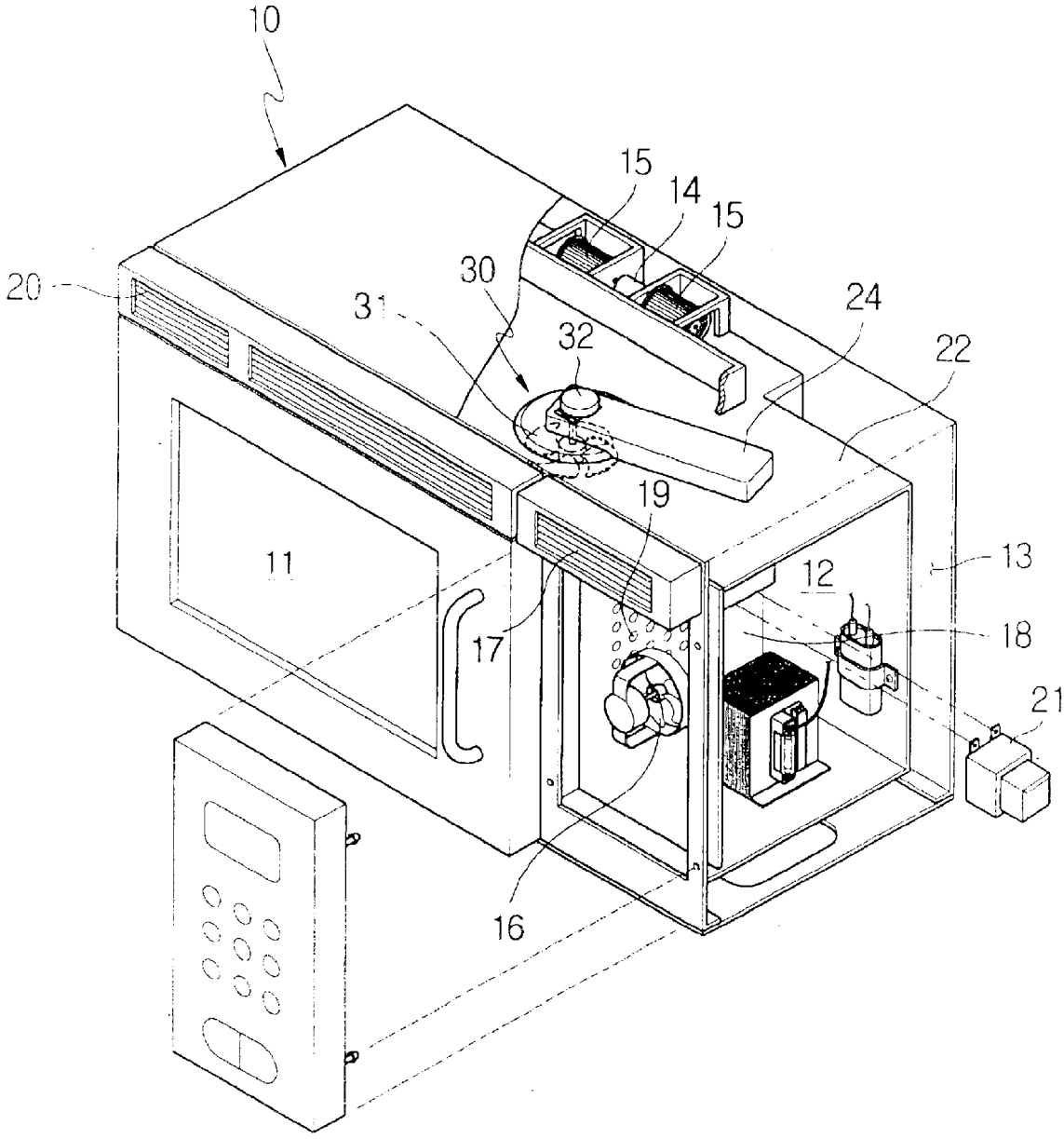
FIG. 1 (Prior Art)
FIG. 1 is an exploded perspective view of a conventional microwave oven.
Figure 2:
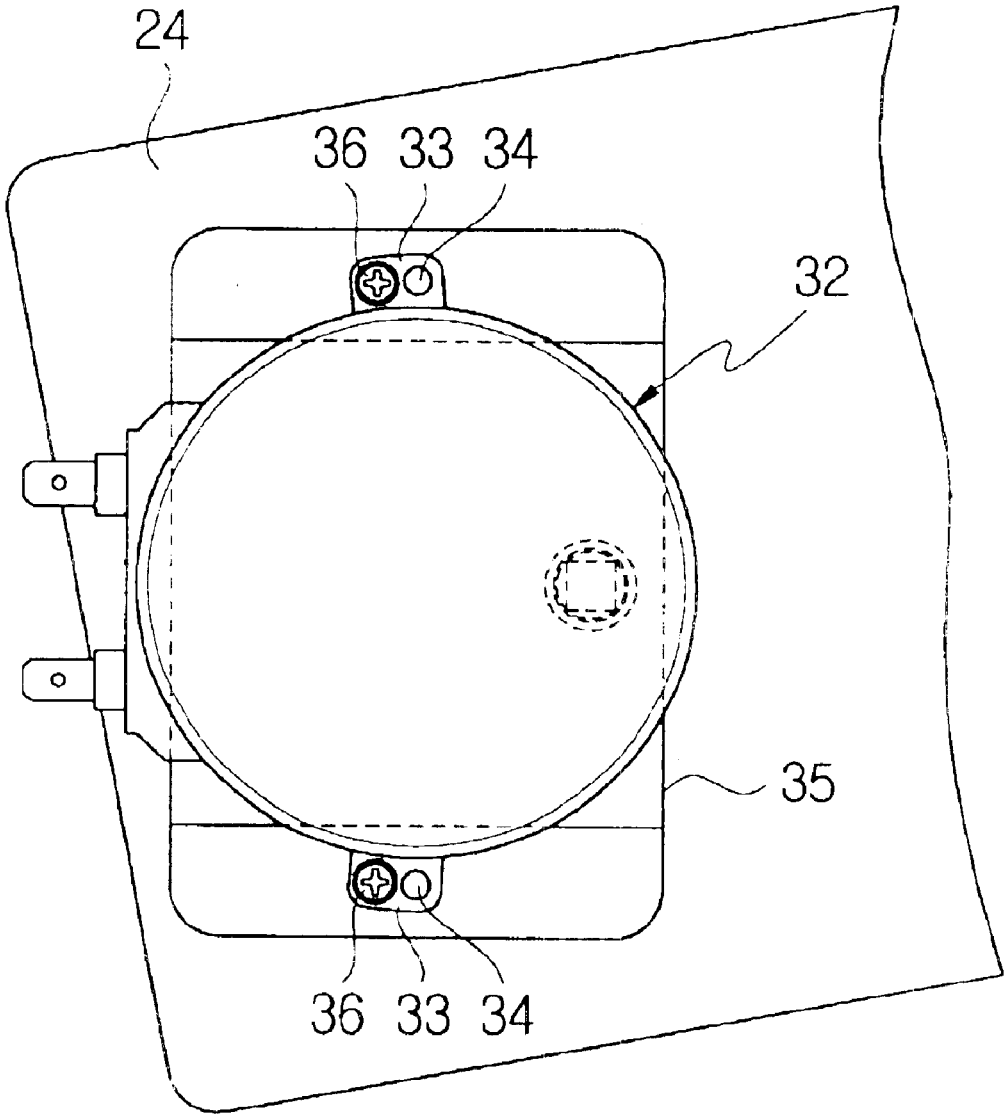
FIG. 2 (Prior Art)
FIG. 2 is a plan view of a motor for a stirrer mounted to the microwave oven of FIG. 1.

Reference will now be made in detail to the present preferred embodiments of the present invention, examples of which are illustrated in the accompanying drawings, wherein like reference numerals refer to like elements throughout. The embodiments are described below in order to explain the present invention by referring to the figures.

The present invention may be applied to both a general type microwave oven and a wall-mountable type microwave oven. However, as an example, the present invention will be described with reference to a wall-mountable type microwave oven.

Figure 3:
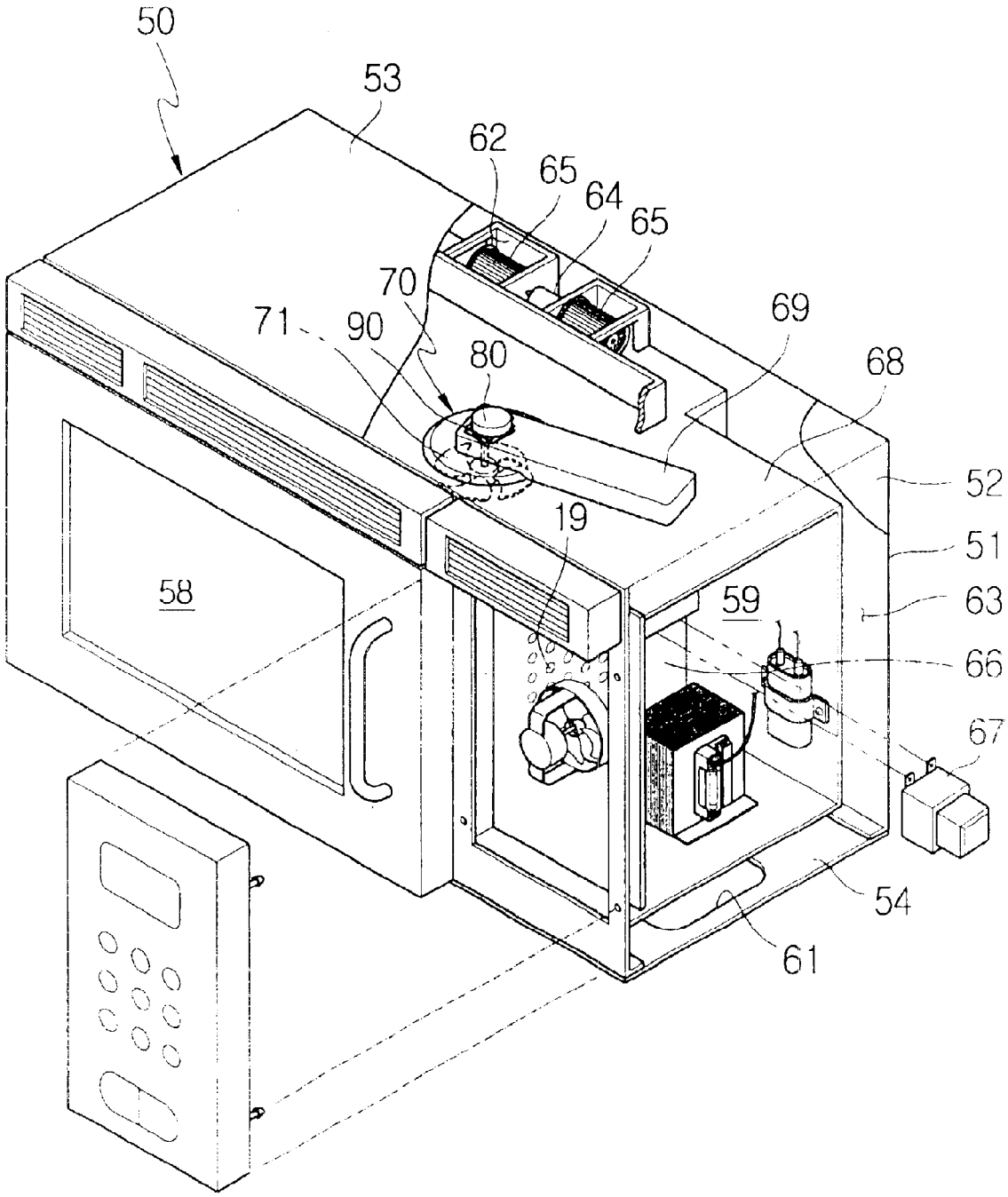
FIG. 3 is an exploded perspective view of a microwave oven according to an embodiment of the present invention.

FIG. 3 shows a wall-mounted type microwave oven according to an embodiment of the present invention. As shown in FIG. 3, the wall-mounted type microwave oven includes a cabinet 50 which defines an external appearance of the microwave oven. A rear plate 51, side plates 52, a top plate 53, and a bottom plate 54 are assembled with each other to form the box-shaped cabinet 50. A cooking cavity 58 and a machine room 59 are provided in the cabinet 50 so as to be partitioned from each other.

Two inlet ports 61 (one shown) are formed on both sides of the bottom plate 54 to suck exhaust gas and food odors produced from an oven range (not shown) into the cabinet 50. An outlet port 62 is provided at an upper portion of the cabinet 50 to discharge the exhaust gas and food odors from the cabinet 50 to the outside of the microwave oven.

Further, the inlet ports 61 and the outlet port 62 communicate with each other through an exhaust passage 63 which is defined by rear and upper portions of the cooking cavity 58 and the machine room 59, and the rear plate 51 and the top plate 53 of the cabinet 50. Thus, the exhaust gas and food odors sucked into the inlet ports 61 pass through the exhaust passage 63 and are discharged to the outside through the outlet port 62.

A fan motor 64 and two exhaust fans 65 are provided at the outlet port 62 to suck the exhaust gas and food odors. The exhaust fans 65 are mounted to both ends of the fan motor 64.

The cooking cavity 58 and the machine room 59 are partitioned from each other by a partition wall 66. Several electrical devices, including a magnetron 67 which generates microwaves, are installed in the machine room 59. Further, a wave guide 69 is provided along a ceiling 68 of the cooking cavity 58 and the machine room 59 to guide the microwaves from the magnetron 67 into the cooking cavity 58.

An outlet of the wave guide 69 is arranged in the cooking cavity 58 to irradiate the microwaves into the cooking cavity 58. A stirrer 70 is mounted to the outlet of the wave guide 69 to uniformly disperse the microwaves throughout the cooking cavity 58.

The stirrer 70 includes a fan 71 and a motor 80. The fan 71 is provided at a position inside the wave guide 69 to disperse the microwaves. The motor 80 is provided on an outer surface of the wave guide 69 to rotate the fan 71. According to an embodiment of the present invention, the motor 80 is mounted to a motor mounting unit 90 which is provided on the outer surface of the wave guide 69. A mounting operation to mount the motor 80 to the motor mounting unit 90 will be described below with reference to FIGS. 4 through 6.

Figure 4:
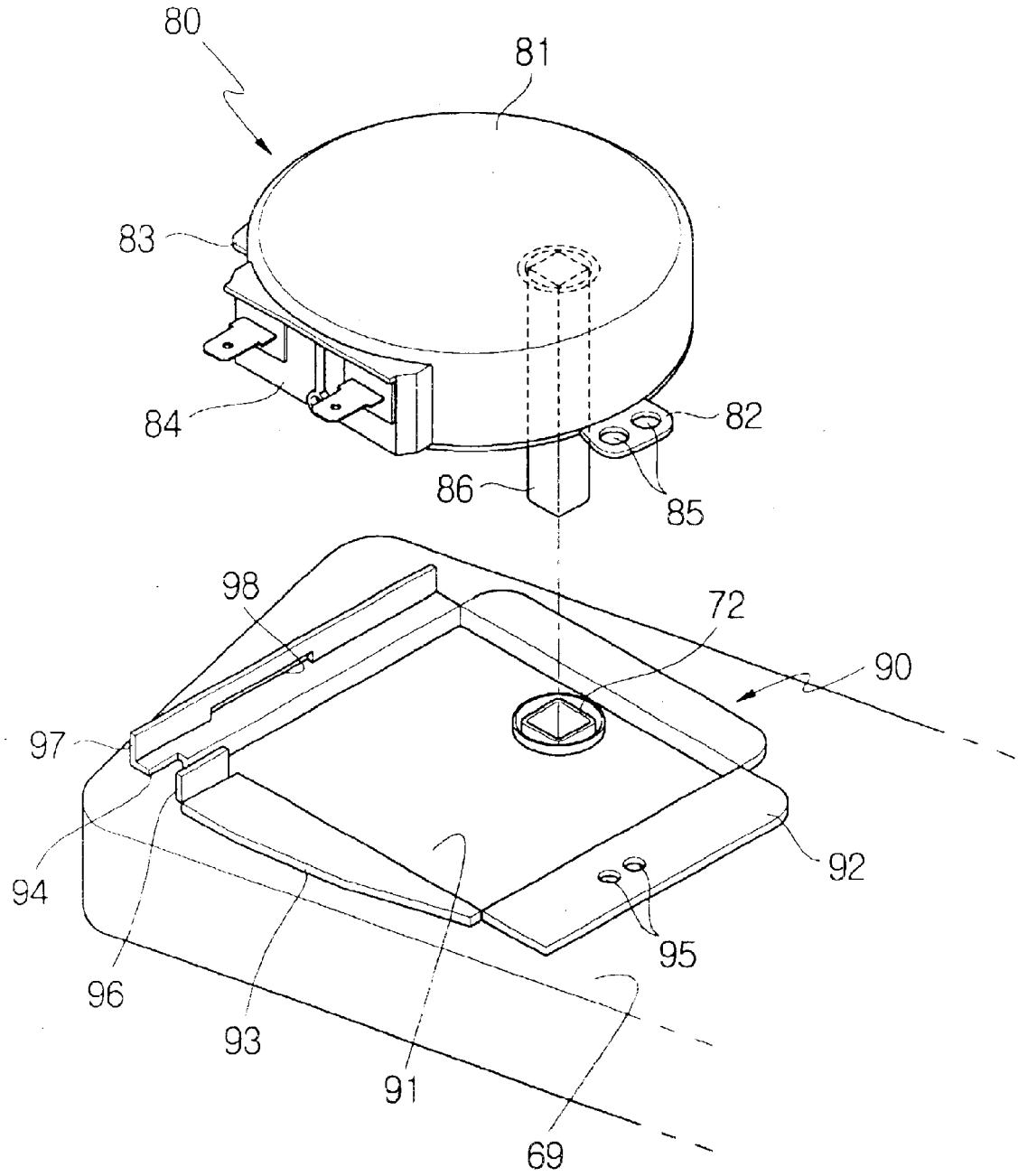
FIG. 4 is an exploded perspective view of a motor for a stirrer illustrated in FIG. 3 and a motor mounting unit for mounting the motor to a wave guide of the microwave oven according to the present invention.

FIG. 4 shows the motor 80 and the motor mounting unit 90 according to an embodiment of the present invention. The motor 80 includes a body 81, first and second flanges 82 and 83, and a terminal unit 84. The body 81 has, for example, a circular cross-section. The first and second flanges 82 and 83 outwardly extend from opposite positions along an outer circumferential surface of the body 81. The terminal unit 84 is forwardly projected from a position between the first and second flanges 82 and 83. A plurality of holes 85 are provided at the first flange 82.

Further, the motor 80 is provided with a rotating shaft 86. The rotating shaft 86 having, for example, a rectangular cross-section is eccentrically provided at the body 81, and is downwardly projected from the body 81. The rotating shaft 86 is seated in a shaft seat 72 which extends from a bottom of the seat 91 of the motor mounting unit 90 to a top of the fan 71 arranged at a position inside the wave guide 69, so as to rotate the fan 71. The shaft seat 72 has a rectangular hole corresponding to the cross-section of the rotating shaft 86.

The motor mounting unit 90 for mounting the motor 80 to the wave guide 69 includes the seat 91 having, for example, a square cross section. The body 81 of the motor 80 is seated on the seat 91 of the motor mounting unit 90. A mounting piece 92 outwardly and horizontally extends from an edge of the seat 91. A first piece 93 outwardly extends from an edge of the seat 91 adjacent to the mounting piece 92. A second piece 94 outwardly extends from an edge of the seat 91 opposite to the mounting piece 92.

The mounting piece 92 is provided with a plurality of holes 95 corresponding to the holes 85 provided at the first flange 82. A stopper 96 is upwardly projected from an end of the first piece 93 which is relatively distant from the mounting piece 92, and functions to delimit a mounted position of the motor 80 where the motor 80 is mounted to the motor mounting unit 90 after the holes 85 and 95 are aligned with each other.

Further, a guide piece 97 is upwardly and longitudinally projected along an edge of the second piece 94 so as to be integrated with the second piece 94 into a single structure. A slot 98 is longitudinally formed along a lower end of the guide piece 97.

An operation of mounting the motor 80 to the motor mounting unit 90 will now be described with reference to FIGS. 5 and 6.

Figure 5:
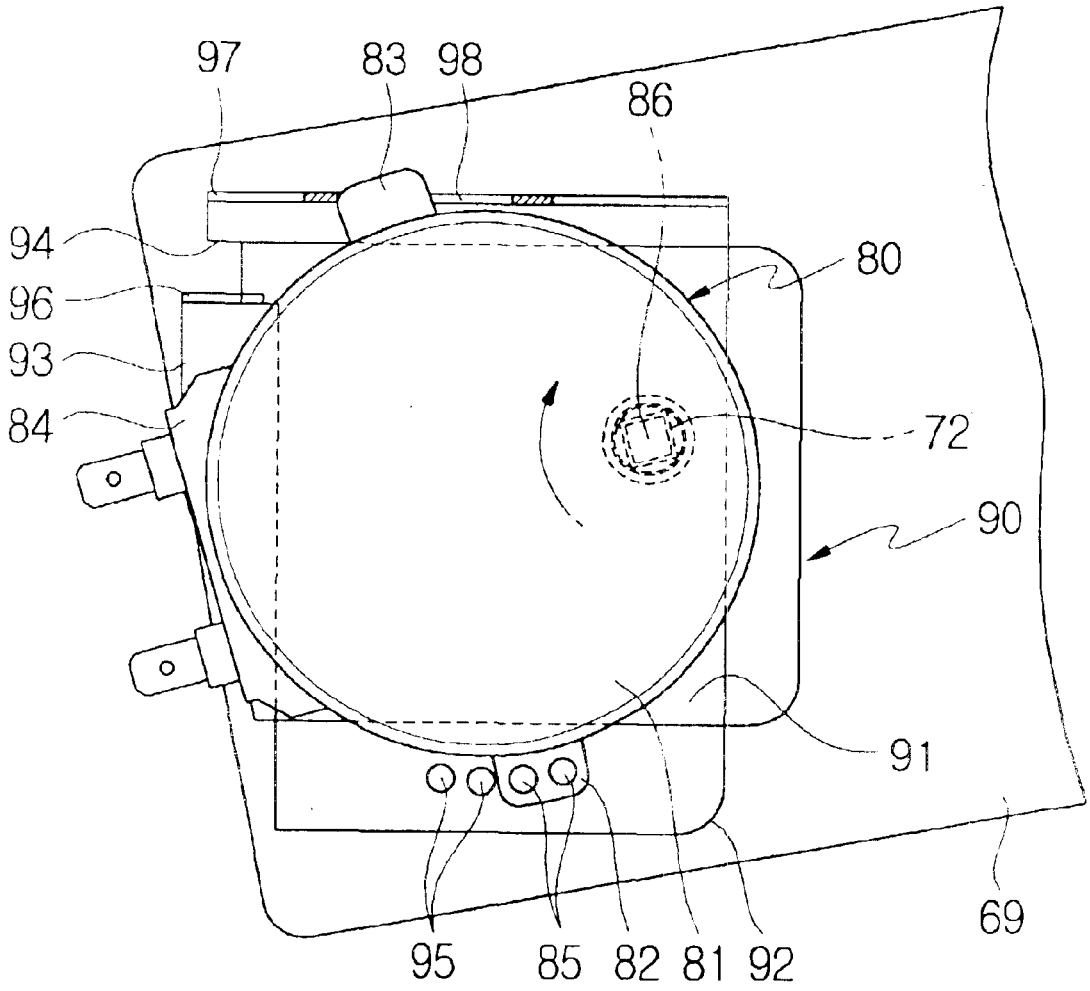
FIG. 5 is a plan view illustrating an initial stage of mounting the motor for the stirrer to the motor mounting unit shown in FIG. 4.

As illustrated in FIG. 5, in an initial stage of mounting the motor 80 to the motor mounting unit 90, the body 81 of the motor 80 is seated on the seat 91 of the motor mounting unit 90, and the first flange 82 of the motor 80 is positioned to the right of the holes 95 of the mounting piece 92. Further, the terminal unit 84 of the motor 80 is placed at a position that is spaced apart from the stopper 96, and the second flange 83 of the motor 80 is fitted into a left side of the slot 98 provided along the guide piece 97.

In such a state, where the motor 50 is rotated in a direction as shown by the arrow of FIG. 5, the second flange 83 is guided along the slot 98 until the terminal unit 84 is stopped by the stopper 96.

Figure 6:
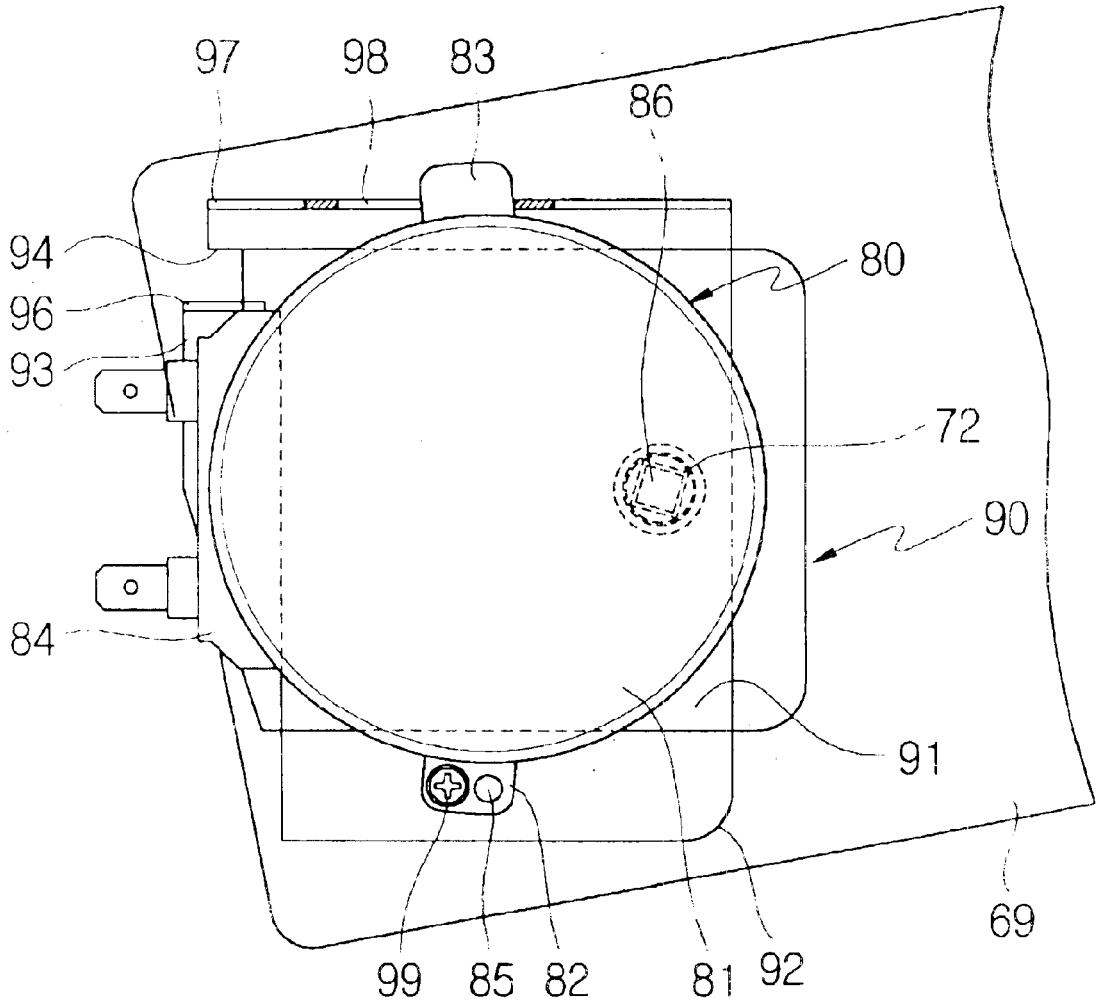
FIG. 6 is a plan view illustrating a final stage where the motor is completely mounted to the motor mounting unit shown in FIG. 4.

As illustrated in FIG. 6, where the terminal unit 84 is stopped by the stopper 96, the holes 85 of the first flange 82 are aligned with the holes 95 of the mounting piece 92. Where the holes 85 and 95 are aligned with each other as shown, a screw 99 is tightened into the aligned holes, thus allowing the motor 80 to be easily and rapidly mounted to the motor mounting unit 90.

According to the present invention, the motor 80 is easily mounted to the motor mounting unit 90 using a single screw. The motor 80 is easily and conveniently mounted to the microwave oven.

While a mounting unit of the present invention has been shown to mount a motor for a stirrer of a microwave oven, it is understood that the present motor mounting unit may be applied to a motor for rotating a cooking tray and to other motors associates with a consumer appliance.

As described above, the present invention provides a microwave oven having a mounting unit Which allows a motor for a stirrer to be easily mounted to an outer surface of a wave guide. A mounted position of the motor is easily delimited using a stopper and a guide piece of the motor mounting unit, thus allowing the motor to be rapidly mounted to the motor mounting unit.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A microwave oven comprising:

a cabinet having a machine room and a cooking cavity;

a magnetron which is installed in the machine room and generates microwaves;

a wave guide which guides the microwaves from the magnetron into the cooking cavity;

a stirrer which is mounted at a predetermined position of the wave guide and comprises:

a fan which disperses the microwaves, and a motor which rotates the fan and includes a flange provided at a predetermined portion of an outer circumferential surface thereof, the flange having at least one hole; and a motor mounting unit which is provided on an outer surface of the wave guide and comprises:

a mounting piece which is provided with at least one hole corresponding to the hole of the flange, and a stopper which delimits a mounted position of the motor when the motor is rotated, to align the at least one hole of the mounting piece with the hole of the flange.

2. The microwave oven according to claim 1, wherein:

the motor mounting unit further comprises a seat which receives the motor, the mounting piece is provided at an edge of the seat, and the stopper is upwardly projected from a first piece which is provided at an edge of the seat adjacent to the mounting piece.

3. The microwave oven according to claim 2, wherein:

the motor mounting unit further comprises a guide piece which is upwardly projected from a second piece that is provided at an edge of the seat opposite to the mounting piece, the guide piece having a longitudinal slot, and the motor further includes a guide flange provided at a position opposite to the flange so as to be fitted into and guided along the longitudinal slot.

4. The microwave oven according to claim 3, wherein:

the motor further includes a terminal unit which is outwardly projected from the outer circumferential surface of the motor at a position between the flange and the guide flange, and the terminal unit is stopped by the stopper of the motor mounting unit in response to the hole of the flange being aligned with the hole of the mounting piece.

5. The microwave oven according to claim 4, wherein the mounting position of the motor is delimited in response to the terminal unit being stopped by the stopper.

6. A cooking appliance comprising:

a cooking cavity to receive food;

a heating unit to cook the food;

a motor unit to operate the cooking appliance, including a flange having at least one hole; and a motor mounting unit which comprises a mounting piece having at least one hole corresponding to the hole of the flange and a stopper that delimits a mounted position of the motor unit when the motor unit is rotated, to align the at least one hole of the mounting piece with the hole of the flange.

7. The cooking appliance according to claim 6, wherein:

the heating unit includes a magnetron which generates microwaves to cook the food, and the motor unit operates a dispersing unit of the cooking appliance that disperses the microwaves to the cooking cavity.

8. The cooking appliance according to claim 7, wherein the cooking appliance is a microwave oven.

9. The cooking appliance according to claim 6, wherein:

the motor mounting unit further comprises a seat which receives the motor unit, the mounting piece is provided at an edge of the seat, and the stopper is upwardly projected from an edge of the seat adjacent to the mounting piece.

10. The cooking appliance according to claim 9, wherein:

the motor mounting unit further comprises a guide piece which is upwardly projected from an edge of the seat opposite to the mounting piece, the guide piece having a slot, and the motor unit further includes a guide flange provided at a position opposite to the flange so as to be fitted into and guided along the slot.

11. The cooking appliance according to claim 10, wherein:

the motor unit further includes a terminal unit which is positioned between the flange and the guide flange, and the terminal unit is stopped by the stopper of the motor mounting unit in response to the hole of the flange being aligned with the hole of the mounting piece.

12. A microwave oven having a cooking cavity, a magnetron which generates microwaves, and a wave guide which guides the microwave to the cooking cavity, the microwave oven comprising:

a stirrer having a motor to disperse the microwaves, the stirrer provided with respect to the wave guide;

a flange having at least one hole provided to the motor; and a motor mounting unit which is provided on the wave guide and comprises:

a mounting piece which is provided with at least one hole corresponding to the hole of the flange, and a stopper which delimits a mounted position of the motor when the motor is rotated, to align the at least one hole of the mounting piece with the hole of the flange.

13. The microwave oven according to claim 12, wherein:

the motor mounting unit further comprises a seat which receives the motor, the mounting piece is provided at an edge of the seat, and the stopper is upwardly projected from an edge of the seat adjacent to the mounting piece.

14. The microwave oven according to claim 13, wherein:

the motor mounting unit further comprises a guide slot, and the motor further includes a guide flange provided to be guided along the guide slot.

15. A motor mounting unit for a microwave oven having a cooking cavity, a magnetron which generates microwaves, a wave guide which guides the microwave to the cooking cavity, and a stirrer having a motor to disperse the microwaves, the motor mounting unit comprising:

a flange having at least one hole provided to the motor; and a motor mount which is provided on the wave guide and comprises:

a mounting piece which is provided with at least one hole corresponding to the hole of the flange, and a stopper which delimits a mounted position of the motor when the motor is rotated, to align the at least one hole of the mounting piece with the hole of the flange.

16. The motor mounting unit according to claim 15, wherein:

the motor mount further comprises a seat which receives the motor, the mounting piece is provided at an edge of the seat, and the stopper is upwardly projected from an edge of the seat adjacent to the mounting piece.

17. The motor mounting unit according to claim 16, wherein:

the motor mount further comprises a guide piece which is upwardly projected from an edge of the seat opposite to the mounting piece, the guide piece having a slot, and the motor further includes a guide flange provided at a position opposite to the flange so as to be fitted into and guided along the slot.

18. A motor mounting unit for a cooking appliance having a cooking cavity, a heating unit, and a motor to operate the cooking appliance, the motor mounting unit comprising:

a flange having at least one hole provided to the motor; and a motor mount which comprises a mounting piece having at least one hole corresponding to the hole of the flange and a stopper that delimits a mounted position of the motor when the motor is rotated, to align the at least one hole of the mounting piece with the hole of the flange.

19. The motor mounting unit according to claim 18, wherein:

the motor mount further comprises a seat which receives the motor, the mounting piece is provided at an edge of the seat, and the stopper is upwardly projected from an edge of the seat adjacent to the mounting piece.

20. The motor mounting unit according to claim 19, wherein:

the motor mounting unit further comprises a guide slot, and the motor further includes a guide flange provided to be guided along the guide slot.

* * * * *